US005534838A

United States Patent [19]

Lindberg

[11] Patent Number: 5,534,838

[45] Date of Patent: Jul. 9, 1996

[54] LOW PROFILE HIGH POWER SURFACE MOUNT TRANSFORMER

[75] Inventor: Paul M. Lindberg, San Diego, Calif.

[73] Assignee: Pulse Engineering, Inc., San Diego, Calif.

[21] Appl. No.: 102,577

[22] Filed: Aug. 5, 1993

[51] Int. Cl.[6] ..... H01F 15/10; H01F 27/30

[52] U.S. Cl. ..... 336/183; 336/192; 336/200; 336/223

[58] Field of Search ..... 336/183, 182, 336/200, 223, 206, 192, 232, 205, 180

[56] References Cited

U.S. PATENT DOCUMENTS

| | | | |
|---|---|---|---|
| 3,102,245 | 8/1963 | Lawson, Jr. | 336/205 |
| 4,395,693 | 7/1983 | Marinesca | 336/232 |
| 4,755,783 | 7/1988 | Fleischer et al. | 336/200 |
| 4,847,984 | 7/1989 | Rossi et al. | 336/200 |

FOREIGN PATENT DOCUMENTS

| | | | |
|---|---|---|---|
| 2503691 | 8/1976 | Germany | 336/223 |
| 62-54905 | 3/1987 | Japan | 336/200 |
| 62-108511 | 5/1987 | Japan | 336/200 |
| 1021344 | 3/1966 | United Kingdom | 336/206 |

OTHER PUBLICATIONS

"Flat Winding Transformer," Radcliffe, IBM Technical Disclosure Bulletin, vol. 22, No. 9, Feb. 1980, pp. 4009–4012.

*Primary Examiner*—Thomas J. Kozma
*Attorney, Agent, or Firm*—Baker, Maxham, Jester & Meador

[57] ABSTRACT

A low profile transformer comprises a support member for supporting a coil winding, a first elongated conductive tape forming at least one conductor having lead terminals formed integral therewith formed into a first coil of multiple turns, a second elongated conductive tape having lead terminals formed integral therewith forming at least one conductor formed into a second coil of at least one turn interleaved with the first coil, and each terminal lead of each of the tapes extending from the support member and having a portion disposed at a base of the transformer for engagement and surface bonding to a PC board.

20 Claims, 2 Drawing Sheets

LOW PROFILE HIGH POWER SURFACE MOUNT TRANSFORMER

BACKGROUND OF THE INVENTION

The present invention relates to electronic components and construction, and pertains particularly to an improved coil and method of manufacturing.

For many years, electronic circuit boards have been fabricated by interconnecting a plurality of electronic components, both active and passive, on a planar printed circuit board. Typically, this printed circuit board has comprised an Epoxy/fiberglass laminate substrate clad with a sheet of copper, which has been etched to delineate the conductive paths. Holes were drilled through terminal portions of the conductive paths for receiving electronic component leads, which were subsequently soldered thereto.

More recently, so-called surface mount technology has evolved to permit more efficient automatic mass production of circuit boards with higher component densities. With this approach, certain packaged components are automatically placed at preselected locations on top of a printed circuit board, so that their leads are registered with, and lie on top of corresponding solder paths or pads. The printed circuit board is then processed by exposure to infrared or vapor phase soldering techniques to re-flow the solder, and thereby establish a permanent electrical connection between the leads and their corresponding conductive paths on the printed circuit board.

The increasing miniaturization of electrical and electronic elements and high density mounting thereof has created increasing problems with construction of electrical components as well as electrical isolation and mechanical interconnection. Demand for even greater miniaturization increase the need for better and more efficient components and techniques of construction. In particular, it creates more difficulty in providing adequate power from smaller components and establishing reliable and efficient connection between packaged components and terminals. Presently known construction and interconnect methods severely limit the ability to provide more compact and powerful components and high density and reliable components and electrical and mechanical isolation between components distinct terminal points due to space limitations.

Among the electrical and electronic elements that must be made more compact and efficient and surface mounted on PC boards are coils, such as transformers, inductors and the like. These must be constructed to be low profile, be high powered and efficient.

The current technique of construction of transformers and other coils is to wind round or square copper wires on a somewhat flat bobbin or pole piece. Layers of tape are wrapped between the layers of wire to provide high voltage insulation. A problem with round wire is that at high frequencies, the current penetrates only a small depth, called skin depth, on the wire surface. To overcome this, some manufactures have used a bundle of small wires, called litz wire. This provides more surface area, but a large portion of the cross-sectional area is unused because of the space between the wires. This is an inefficient use of the space taken up by the bundle of wires.

Conductive tapes have been proposed to reduce the above density problem. A conductive tape is wound alternately with an insulating tape on a conventional bobbin, with round wires soldered at the ends of the tape for terminal lead connections. However, this terminal lead structure adds thickness to the assembly and defeats efforts to miniaturize the transformer. For example, a 20 mil wire soldered to a 2.5 mil tape will typically result in a 30 mil thickness.

Another approach to miniaturization has been to go to a planar magnetic transformer. This structure has a circuit board type construction wherein sheets of conductive plates are formed with a center hole wherein the core extends perpendicular to the surface of the plates or circuit boards. Leads for the planar magnetic construction extend down through holes in the printed circuit boards. This provides a low profile, but is expensive and low powered.

It is, therefore, desirable that an improved transformer construction with high power, low profile and with improved lead form for termination and surface mounting be available.

SUMMARY AND OBJECTS OF THE INVENTION

It is the primary object of the present invention to provide an improved electrical transformer coil and method of making.

In accordance with a primary aspect of the present invention, a low profile transformer comprises a support member for supporting a coil winding, a first elongated conductive tape forming at least one conductor formed into a first coil of multiple turns having terminal ends, a second elongated conductive tape forming at least one conductor formed into a second coil of at least one turn interleaved with said first coil, and each terminal end of each of said tapes extending from said support member and having a portion disposed at said base for engagement and surface bonding to a PC board.

BRIEF DESCRIPTION OF THE DRAWING

The above and other objects and advantages of the present invention will become apparent from the following description when read in conjunction with the accompanying drawings wherein.

DETAILED DESCRIPTION OF A PREFERRED EMBODIMENT

Figures 1, 2, 3, 4, 5:
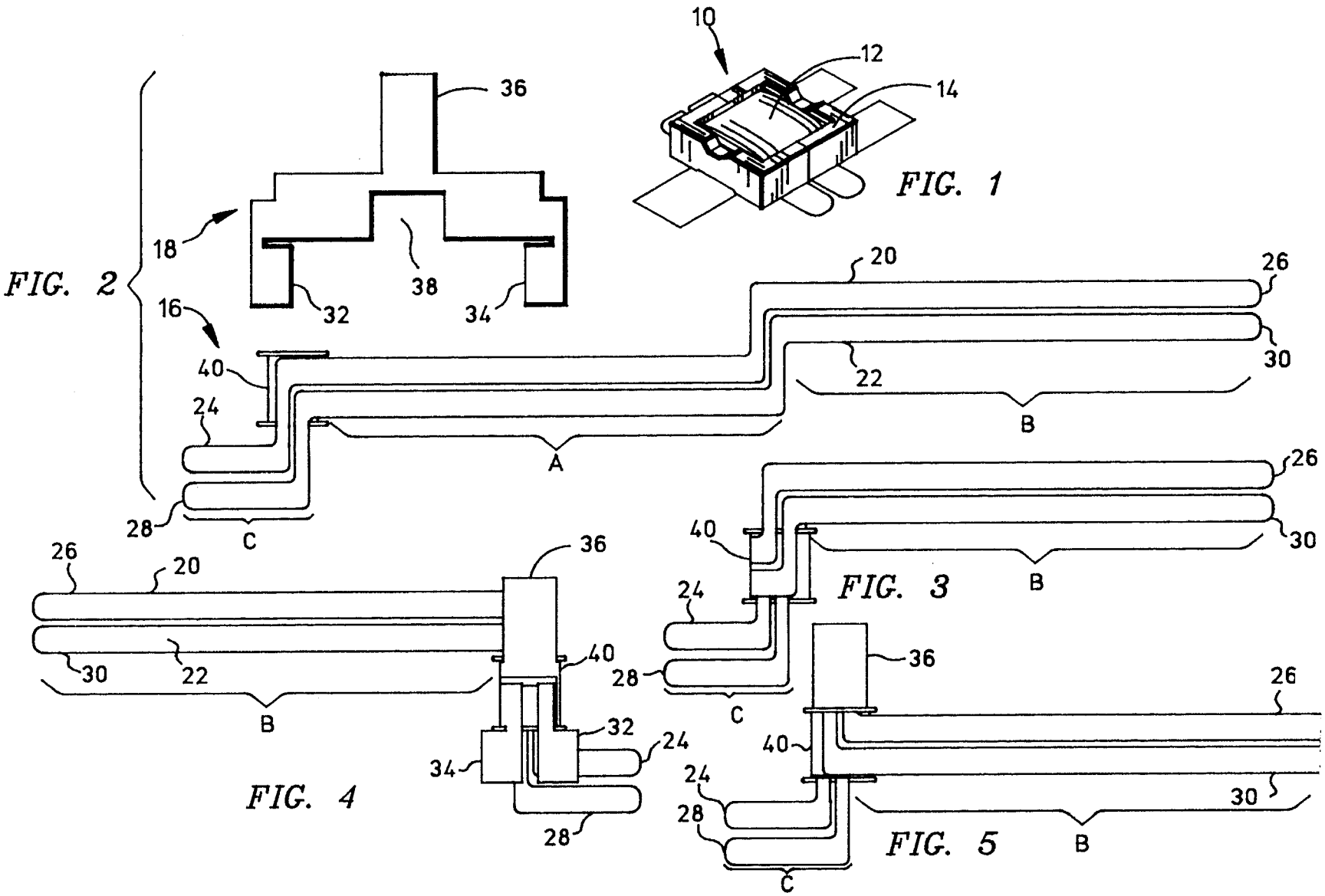
FIG. 1 is a perspective view illustrating a preferred embodiment of the invention.
FIG. 2 is a top plan view illustrating the geometry of the embodiment of FIG. 1.
FIG. 3 is a top plan view of the embodiment of FIG. 1 in a first stage of assembly wherein the first section of the primary coil is wound on a bobbin.
FIG. 4 is a bottom plan view of the embodiment of FIG. 1 in a second stage of assembly wherein the secondary coil has been wound on the bobbin.
FIG. 5 is a view like FIG. 3 of a further stage of assembly of the invention wherein the second section of the primary coil is folded over and aligned to be wound on the bobbin on top of the secondary coil.

Referring to the drawings, particularly FIG. 1, there is illustrated an exemplary embodiment of a compact, low profile transformer constructed in accordance with a preferred embodiment of the invention, designated generally by the numeral 10. The transformer 10 has a very low height and comprises a coil assembly 12 contained within a double E type core 14, with terminals projecting from beneath or at the base of the frame of the core assembly 14 for surface bonding to a PC board.

Referring to FIG. 2, major components of the transformer assembly, including a pair of conductive tapes, each designated generally by the numerals 16 and 18, respectively, are illustrated. The tape 16 is constructed of a conductive material and preferably a material such as copper and a dielectric laminate. However, it is apparent that separate conductive and insulation tapes can be used. The strip or tape 16 is formed of two conductive paths 20 and 22 and forms the primary coil or winding of the transformer. The tape is constructed in two main sections, A for forming the A winding of the primary coil and B for forming the B section of the primary coil. These sections are offset from one another to position them in a non-interfering position with respect to the bobbin or support structure on which it is wound.

The tape is provided with terminal leads 24 and 26 for conductive strips 20, and terminal leads 28 and 30 for conducting the strip 22. The winding will thus have built-in, self-leaded terminals. The lead terminals 24 and 28 on one end adjacent section A are offset from the section A to permit winding of the coil sections A and B onto the bobbin or other support structure. The conductive strip for the illustrated embodiment is preferably on the order of about one-thousandths of an inch in thickness. The insulation layer preferably overlaps the edge of the conductive layer.

The secondary coil or winding is formed by the conductive tape 18 which is precision formed, preferably of a material similar to that of the conductive strip or tape 16, however with a preferred thickness of about six-thousandths of an inch. This conductive tape is formed with laterally extending terminal leads or ends 32 and 34 and a central laterally extending terminal lead 36. The central terminal 36 is on the opposite side of the terminals 32 and 34 and is directly opposite a notch or cut-out 38 which, as will be subsequently described, provides a recess for a portion of the terminals 32 and 34 for maintaining a low profile.

The coil is formed or wound by selecting suitable support means for the tapes, such as a bobbin or merely a winding support bar. For example, the conductive tapes may be wound on a support mandrel and then removed for final assembly on a suitable core. For the purposes of illustration, a bobbin or similar support member 40 is selected and properly positioned at one end of the section A in alignment therewith for winding that section onto the bobbin or other support structure. The tape is positioned and wound onto the bobbin such that when the first section is wound, the assembly appears as shown in FIG. 3, with the offsets of tabs 24 and 28 positioned on the same side of the bobbin and substantially aligned with the offset of the section B portion of the tape.

After the section A of the tape has been wound on the support member 40, it will appear as shown in FIG. 3, with both sections B and the terminals ends of section A offset axially to either side of the support member 40. As shown in FIG. 3, both tab sections 24, 28 and section B are on top of the support member. The assembly is then turned over, that is, rotated one-hundred eight degrees about the axis of the support member 40, and the tape 18 defining the secondary winding is started at what is now the top of the support member, as shown in FIG. 4. The tape 18 is wound clockwise about the support member 40 until the terminal end 34 is positioned adjacent terminal end 32 over, and received in the slot 38. This places the terminal ends 32, 34 and 36 in a position which is now on top of the support or bobbin 40. They also extend outward axially to the side of the bobbin or support member.

At this stage, the assembly is rotated another one-hundred eighty degrees to present the arrangement wherein the second section B is on top, as shown in FIG. 3, but with the tape 18 wound about the bobbin. The section B of the primary tape 16 is then folded across its offset to place the section B in line to be wound on the bobbin, as shown in FIG. 5. The section B is then wound on the bobbin, producing a structure as shown in FIG. 6, with the terminal ends 26 and 30 extending outward from the bobbin 40.

Figures 6, 7, 8, 9, 10:
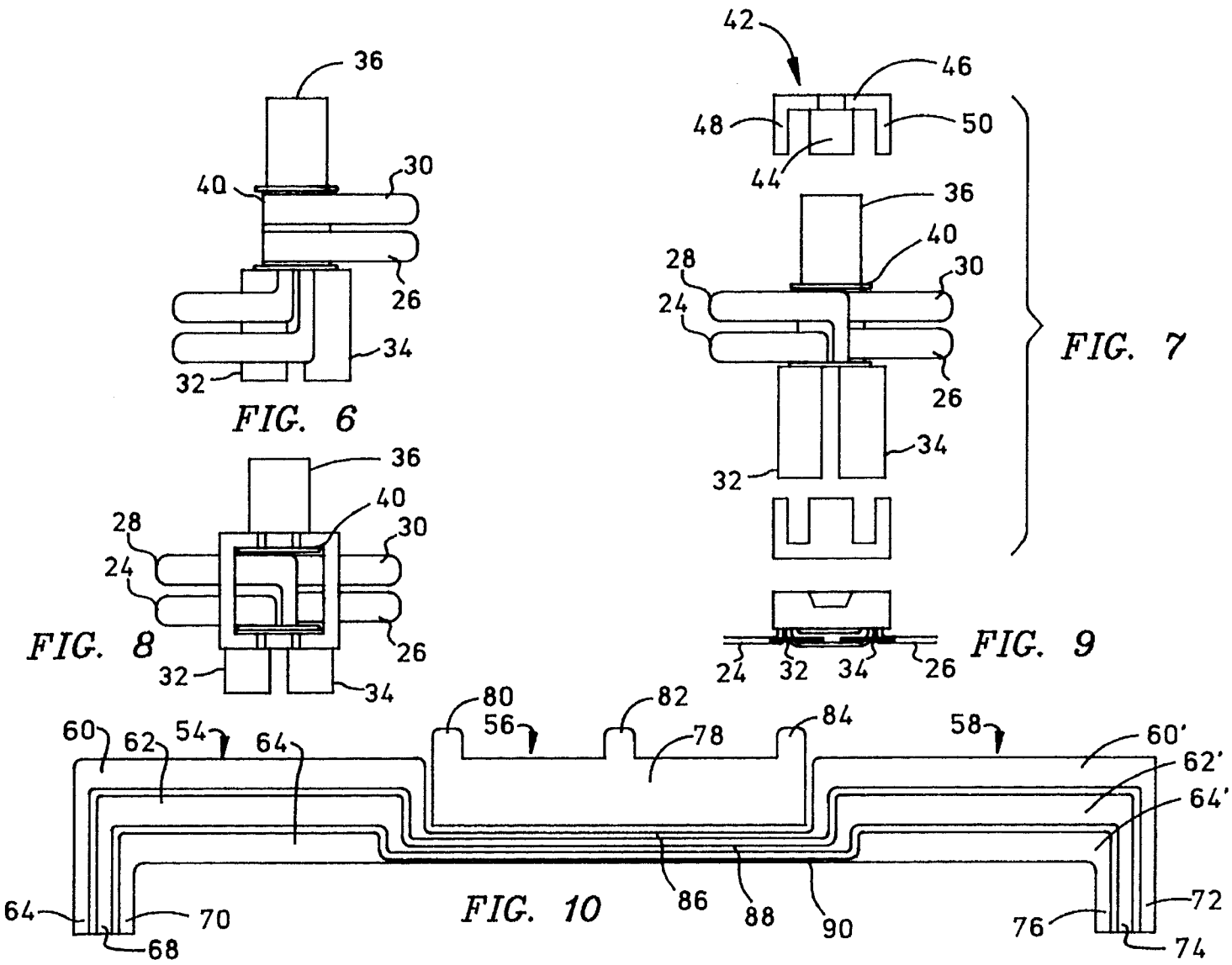
FIG. 6 is a view like FIG. 5 of another stage of assembly wherein the second section of the primary coil is wound on the bobbin.
FIG. 7 is a view like FIG. 6 of a still further stage of assembly.
FIG. 8 is a top plan view of a final stage of assembly.
FIG. 9 is an end elevation view of the completed assembly.
FIG. 10 is a view like FIG. 2 of the components of an alternate embodiment.

The offset terminals leads 24 and 28 are then folded over across the offset, positioning them in line with the bobbin as shown in FIG. 7. The terminals 24, 26, 28 and 30 are then pressed downward below the rectangular hole for passage through the bobbin. A suitable core assembly, such as a double E type core assembly, is selected and inserted in the throughhole or bore of the bobbin, such that side frame pieces of the core assembly overlie the terminal leads, as shown in FIG. 8. The double E core assembly is made up of two identical generally E-shaped members 42 having a central core portion 44, end frame member 46 and two side frame members 48 and 50. These are inserted into the ends of the bobbin facing one another so that the side frame members 48 and 50 engage, as shown in FIG. 8, and overlie the lead terminals. The leads are thus presented below the coil assembly in a position for surface bonding to a PC board.

It may be necessary in some instances to provide greater insulation to handle higher voltage requirements. This can be provided by extending the insulation layer over and around the edges of the conductive tape so that they are completely covered.

Referring to FIG. 10, an alternate geometric configuration is illustrated for the conductive tape assembly. In this embodiment, for example, the primary and secondary windings are embodied in the same tape, as illustrated in FIG. 10. It is also apparent that the tapes can be separate, but geometrically formed to nest together so that they can be wound radially on the same support. The tape is selected to have an appropriate thickness, and the conductive strips are then formed with suitable widths. The conductive tapes can be formed from large sheets of copper insulator laminate, and using an etching, such as photo chemical etching and photo lithographic technique to form conductive paths. Patterns for the conductive strips can be generated by a computer as a master for etching windings or paths and pads on the laminate. This approach can provide a very high degree of accuracy in the components.

The tape assembly, as illustrated, provides an in-line arrangement of the primary coil windings and the secondary coil winding. The assembly, designated generally by the numeral 52, comprises a first primary coil section, designated generally at 54, with an adjacent and substantially in-line secondary coil winding section 56 and following that, a second primary coil winding section 58. In the illustrated embodiment, the primary winding is provided with three conductive strips 60, 62 and 64 having lead terminals 66, 68 and 77 at one end. The second section 58 of the primary winding is provided with conductive strips 60', 62' and 64', with lead terminals 72, 74 and 76 at the opposite end. The two sections of the primary winding are connected by narrow conductive strips 86, 88 and 90. Disposed substantially at the center of the overall tape assembly is a secondary coil winding 78 with lead terminals 80, 82 and 84.

This in-line arrangement provides a geometry that permits easy winding of the overall tape assembly onto a bobbin or other suitable support. This construction permits the use of machine winding and assembly. The various lead terminals are positioned on the respective conductive strip so that upon winding on the bobbin or other support, the lead terminals will be positioned as desired with respect to the overall coil structure. The primary and secondary conductive paths can be connected in any suitable number of parallel or series arrangements to provide the desired number of windings and transformer characteristics. Any number of geometrical arrangements may be provided for the conductive tape assembly. For example, any number of primary windings can be provided, as well as any number of secondary windings, e.g. secondary, tertiary, quarternary, etc. The terminal leads are formed by an appropriately extended integral piece of the tape.

While I have illustrated and described my invention by means of specific embodiments, it should be understood that numerous changes and modifications may be made therein without departing from the spirit and scope of the invention as defined in the appended claims.

I claim:

1. A low profile transformer, comprising:

a support member for supporting a coil winding;

a first elongated conductive tape section having at least one conductor having co-planar lead terminal formed integral therewith formed into a first coil of at least one turn on said support member;

a second elongated conductive tape section having at least one conductor having co-planar lead terminals formed integral therewith wound into a second coil of at least one turn directly on said first coil;

a third elongated conductive tape section having at least one conductor having a co-planar lead terminal formed integral therewith and said third tape section formed as a co-planar continuation of said first tape section with a laterally extending interconnection providing co-planar exit and co-planar entrance between coils of said first tape section and said third tape section, said third tape section wound directly on said second coil so that said second elongated conductive tape is interleaved between said first and third sections, said conductor of said first tape section, said conductor of said third tape section and said laterally extending interconnection consisting of a single continuous conductor, said terminal leads of each of said conductive tape sections extending from and disposed in a common plane at a base of said support member for engagement and surface bonding to a PC board.

2. A low profile transformer according to claim 1 wherein each said conductive tape section is copper and dielectric laminate.

3. A low profile transformer according to claim 1 wherein said first conductive tape section has at least two conductive paths.

4. A low profile transformer according to claim 1 wherein one of said first and second sections has the lead terminals at one end which are offset from the respective section,

5. A low profile transformer according to claim 4 wherein said terminals are formed by a portion of the tape at the end of said first section,

6. A low profile transformer according to claim 1 wherein:

said first and second conductive tape sections are formed from separate copper and dielectric laminates; and said lead terminals of said second tape section extend from sides of said tape.

7. A transformer according to claim 1, wherein said first conductive tape section and said third tape section are continuations of a common tape of copper and dielectric laminate and are laterally offset from one another.

8. A transformer according to claim 7, wherein said terminal leads of said first conductive tape section and said third tape section extend generally longitudinally from ends thereof.

9. A transformer according to claim 8, wherein said terminal leads of said second conductive tape section extend generally laterally from ends thereof.

10. A transformer according to claim 1, wherein said first conductive tape section and said third tape section have at lease two parallel conductive paths.

11. A transformer according to claim 1, wherein said support member is a core.

12. A low profile transformer according to claim 11 wherein said support member is a core.

13. A low profile transformer according to claim 11 wherein said first conductive tape has a plurality of conductive paths disposed in side by side relation on said tape.

14. A low profile self leaded transformer, comprising:

a substantially fiat rectangular support member for supporting a coil winding, said support member having a base;

a first elongated conductive tape of elongated continuous laminate of copper and dielectric formed into longitudinally disposed laterally offset first and second co-planar conductor sections interconnected by a laterally extending co-planar exit and entrance conductor, said first conductor section, said second conductor section and said laterally extending co-planar exit and entrance conductors consisting of a single continuous conductor, each conductor section having at least one conductor having a co-planar lead terminal formed integral therewith;

a second elongated conductive tape of elongated continuous laminate of copper and dielectric having at least one conductor having a co-planar lead terminal formed integral therewith and extending laterally therefrom, said first conductor section wound on said support member, said second elongated conductive tape wound directly on said first conductor section, said second conductor section wound directly on said second conductive tape, and wherein each of said lead terminals extending from said support member and disposed in a common plane at said base for engagement and surface bonding to a PC board.

15. A transformer according to claim 14, wherein said first and second conductor tape sections have a plurality of parallel conductors.

16. A transformer according to claim 14, wherein said terminal leads of said first and second conductor sections extend generally longitudinally from ends thereof.

17. A transformer according to claim 16, wherein said support member is a core.

18. A low profile inductor for surface mounting to a PC board, comprising:

a substantially flat rectangular support member having a core with a central post for supporting a coil winding and a peripheral frame having a peripheral base;

a first elongated continuous conductive tape of a copper and dielectric laminate having at least a pair of elongated copper conductors, each having a lead terminal formed integral therewith, each of said conductors formed into first and second longitudinally positioned laterally disposed conductor sections, including a laterally extending offset interconnect conductor from said first section to said second section entirely within a common plane therewith, said first conductor section, said second conductor section and said laterally offset interconnect conductor consisting of a single continuous conductor;

a second elongated continuous conductive tape of a copper and dielectric laminate having lead terminals formed in a common plane integral therewith, wherein said first conductor section is wound on said central post for forming a first coil winding of multiple turns, said second conductive tape forming at least one conductor wound on top of said first section for forming a second coil winding of at least one turn, said second section wound on top of said second coil winding for forming a third coil winding of multiple turns wherein said second conductive tape is interleaved between said first and said second conductor sections, said terminal lead of each of said tapes extending from said support member in a common plane disposed at said peripheral base engagement and surface bonding to a PC board.

19. An inductor according to claim 18 wherein said terminal leads of said first and said third conductor sections extend generally longitudinally from ends thereof.

20. An inductor according to claim 18 wherein said terminal leads of said second conductor section extends generally laterally from ends thereof to one side and from a center thereof to another side thereof.

* * * * *